US010895383B2

(12) United States Patent
Pascaud et al.

(10) Patent No.: US 10,895,383 B2
(45) Date of Patent: Jan. 19, 2021

(54) RING-SHAPED COMBUSTION CHAMBER FOR A TURBINE ENGINE

(71) Applicant: SAFRAN HELICOPTER ENGINES, Bordes (FR)

(72) Inventors: Stéphane Pascaud, Pau (FR); Guillaume Taliercio, Rontignon (FR)

(73) Assignee: SAFRAN HELICOPTER ENGINES, Bordes (FR)

( * ) Notice: Subject to any disclaimer, the term of this patent is extended or adjusted under 35 U.S.C. 154(b) by 211 days.

(21) Appl. No.: 15/765,823

(22) PCT Filed: Oct. 4, 2016

(86) PCT No.: PCT/FR2016/052539
§ 371 (c)(1),
(2) Date: Apr. 4, 2018

(87) PCT Pub. No.: WO2017/060605
PCT Pub. Date: Apr. 13, 2017

(65) Prior Publication Data

US 2018/0299127 A1 Oct. 18, 2018

(30) Foreign Application Priority Data

Oct. 6, 2015 (FR) ..... 15 59491

(51) Int. Cl.
*F23R 3/06* (2006.01)
*F23R 3/50* (2006.01)
(Continued)

(52) U.S. Cl.
CPC ..... *F23R 3/06* (2013.01); *F23R 3/26* (2013.01); *F23R 3/50* (2013.01); *F23R 3/54* (2013.01)

(58) Field of Classification Search
CPC .... F23R 3/002; F23R 3/06; F23R 3/04; F23R 3/10; F23R 3/50; F23R 3/54
See application file for complete search history.

(56) References Cited

U.S. PATENT DOCUMENTS 3,671,171 A 6/1972 Doyle
5,579,645 A * 12/1996 Prociw ..... F23D 11/107 239/404
(Continued)

FOREIGN PATENT DOCUMENTS

CN 1701203 A 11/2005
CN 102282423 A 12/2011
(Continued)

OTHER PUBLICATIONS

Office Action issued in Chinese Patent Application No. 201680058929.7, dated Sep. 29, 2019 (8 pages).
(Continued)

*Primary Examiner* — Gerald L Sung
*Assistant Examiner* — Rene D Ford
(74) *Attorney, Agent, or Firm* — Bookoff McAndrews, PLLC

(57) ABSTRACT

An annular combustion chamber (10) having a first annular wall (12) and a second annular wall (13) that are coaxial about an axis (X), a chamber end wall (14) connecting together the first and second walls (12, 13), and a plurality of injectors (16), the first wall (12) including first air feed holes (18) downstream from the injectors (16), the combustion chamber (10) being characterized in that for at least a first one of said injectors (16), at least three of the first holes (18) sharing the first injector as their closest injector are situated at equal distances (D) from the first injector (16).

12 Claims, 2 Drawing Sheets

(51) Int. Cl.
*F23R 3/54* (2006.01)
*F23R 3/26* (2006.01)

(56) References Cited

U.S. PATENT DOCUMENTS

| | | | | |
|---|---|---|---|---|
| 7,509,809 | B2 * | 3/2009 | Patel | F02C 3/14 60/754 |
| 2009/0013530 | A1 * | 1/2009 | Rudrapatna | F23R 3/002 29/888 |
| 2010/0162712 | A1 | 7/2010 | Zupanc et al. | |
| 2010/0218504 | A1 * | 9/2010 | Bronson | F23R 3/045 60/754 |
| 2011/0271678 | A1 * | 11/2011 | Bourgois | F23R 3/06 60/722 |
| 2012/0137697 | A1 | 6/2012 | Sandelis | |
| 2012/0304647 | A1 | 12/2012 | Dudebout et al. | |

FOREIGN PATENT DOCUMENTS

| | | | |
|---|---|---|---|
| CN | 204460285 | U | 7/2015 |
| EP | 0569300 | A1 | 11/1993 |
| EP | 0818658 | A1 | 1/1998 |
| EP | 2317226 | A2 | 5/2011 |
| FR | 2 941 287 | A1 | 7/2010 |
| JP | H05-203147 | A | 8/1993 |

OTHER PUBLICATIONS

Search report issued in Chinese Patent Application No. 201680058929.7, dated Sep. 20, 2019 (2 pages).

International Search Report and English Translation dated Jan. 13, 2017, in International Application No. PCT/FR2016/052539 (7 pages).

* cited by examiner

FIG.1
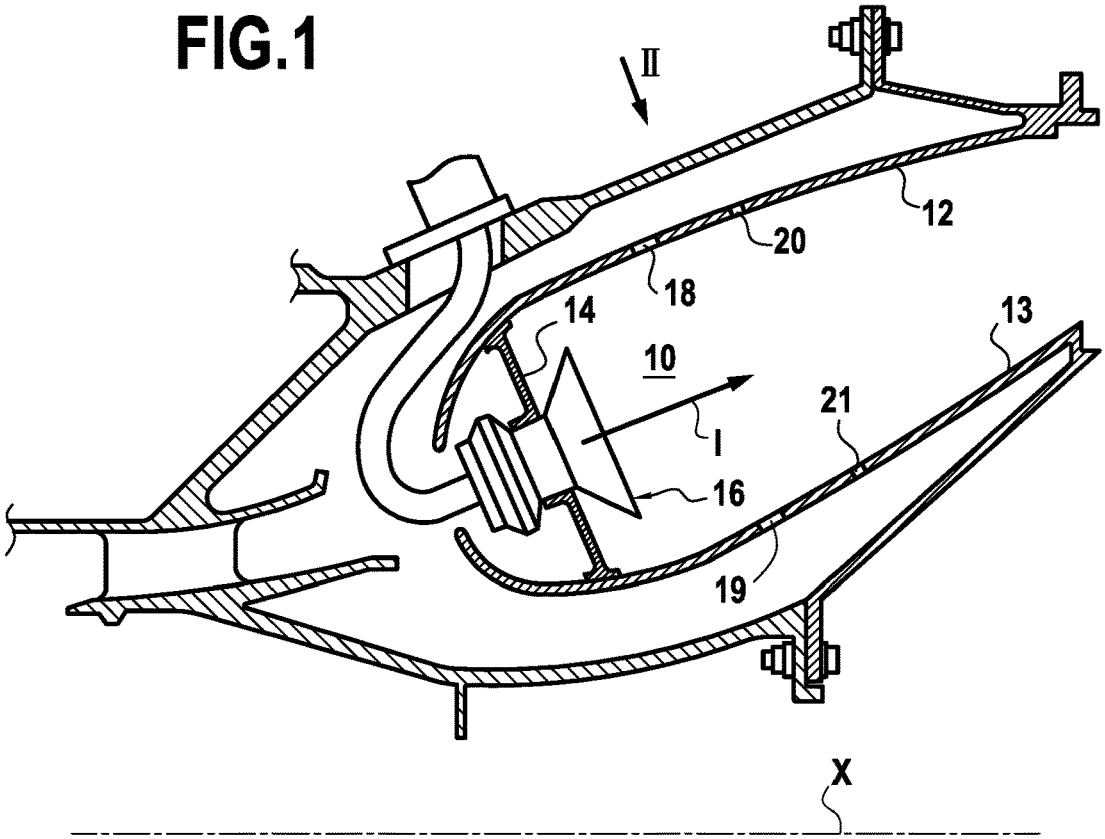
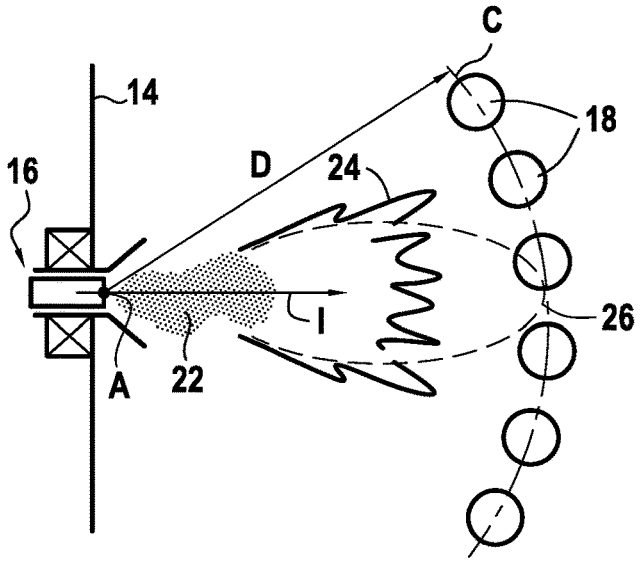
FIG.2

FIG.3
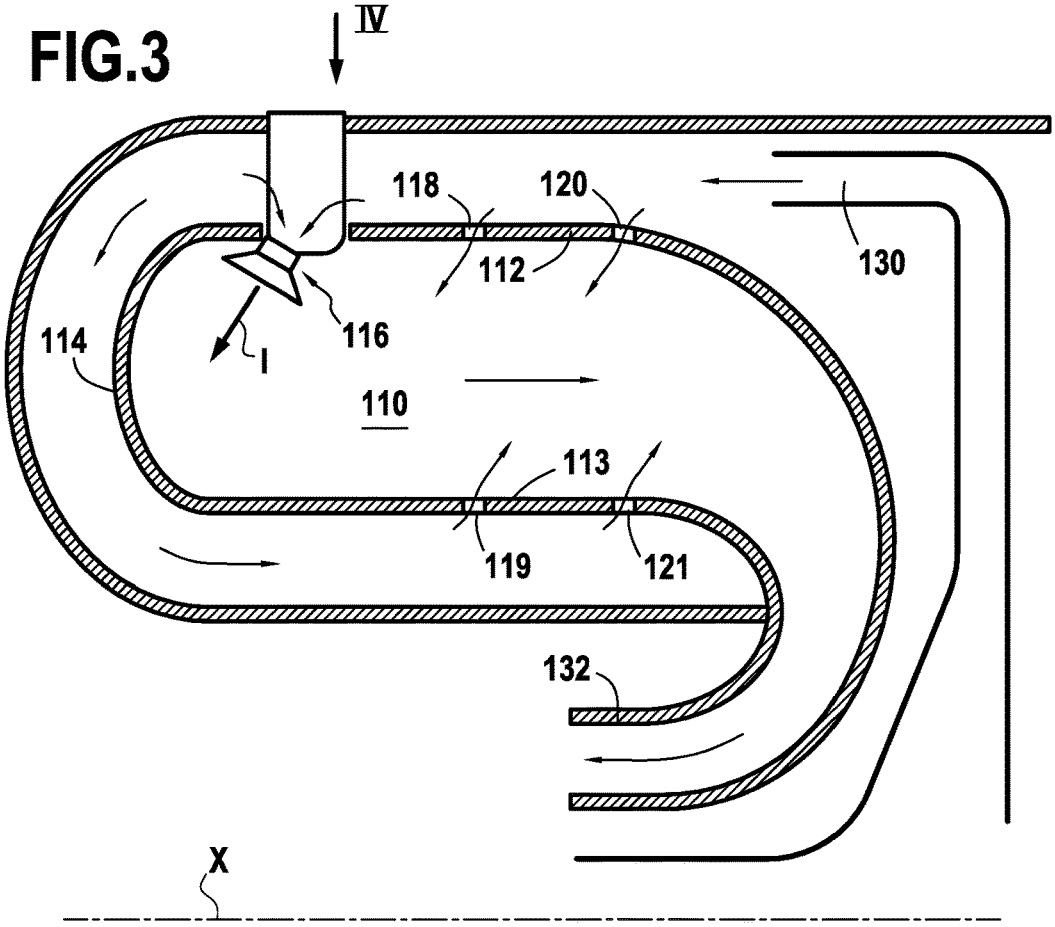
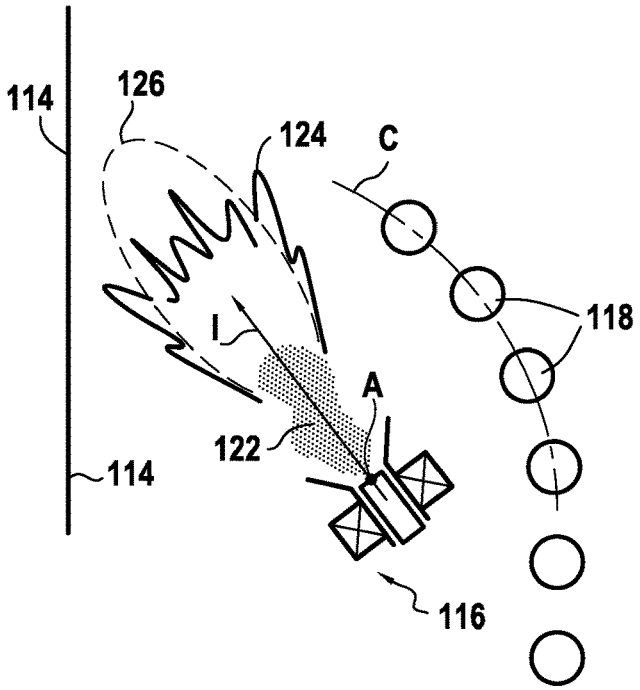
FIG.4

RING-SHAPED COMBUSTION CHAMBER FOR A TURBINE ENGINE

CROSS-REFERENCE TO RELATED APPLICATION(S)

This patent application is a U.S. national phase entry under 35 U.S.C. § 371 of International Application No. PCT/FR2016/052539, filed Oct. 4, 2016, which claims benefit under 35 U.S.C. § 119 to French Application No. 1559491, filed Oct. 6, 2015, the entireties of each of which are incorporated herein by reference.

FIELD OF THE INVENTION

The present disclosure relates to an annular combustion chamber, and more particularly to an annular combustion chamber having a first annular wall and a second annular wall that are coaxial about an axis, a chamber end wall connecting together the first and second walls, and a plurality of injectors, the first wall including first air feed holes downstream from the injectors. Such a combustion chamber may be a turbine engine combustion chamber.

TECHNOLOGICAL BACKGROUND

Combustion chambers of this type are known, e.g. from Document EP 0 569 300 that describes a guillotine device serving to modify the axial position of a member for shutting primary feed holes. Thus, the distance between the air feed passages and the chamber end wall can be controlled while the combustion chamber is in operation, thus making it possible to provide a combustion chamber that pollutes little.

Nevertheless, such a system is complex and does not provide good control over the temperature field at the outlet from the combustion chamber. However, that temperature field is very important for ensuring that the burnt gas leaving the combustion chamber does not damage the turbine adjacent to said chamber. There therefore exists a need for a novel type of combustion chamber.

SUMMARY OF THE INVENTION

This object is achieved by the fact that for at least a first one of said injectors, at least three, and preferably at least four, of the first holes sharing the first injector as their closest injector are situated at equal distances from the first injector.

Since the at least three or four first holes are situated at equal distances from the injector that is closest to them, i.e. the first injector, said first holes are arranged on a circular arc centered on the first injector. A circular arc is a curve that is strictly convex in a radial view, and specifically it has its concave side facing towards the first injector. In other words, in a radial projection, the curve defines a surface that is strictly convex, with the injector being situated inside said surface. It should be recalled that a convex surface is a surface such that for any two points lying on the convex surface, the straight line segment connecting those two points together lies entirely inside said convex surface. Furthermore, a surface is strictly convex if the curve defining it does not contain any straight line portion.

Thus, unlike the usual approach, which consists in determining the positions of the first holes relative to the chamber end wall and in putting them into alignment, the present disclosure proposes determining the positions of the first holes relative to the injector that is closest to said holes. This gives rise to better control over the flow and over the temperature field in the combustion chamber.

The first injector, and preferably all of the injectors, may be placed in the end wall of the chamber or in one of the annular walls, in particular in the first wall.

The term "axis of the combustion chamber" is used to designate its axis of symmetry (or quasi-symmetry). The axial direction corresponds to the direction of the axis of the combustion chamber, and a radial direction is a direction perpendicular to the axis of the combustion chamber and intersecting that axis. Likewise, an axial plane is a plane containing the axis of the combustion chamber, and a radial plane is a plane perpendicular to that axis. A circumference should be understood as a circle lying in a radial plane and having its center lying on the axis of the combustion chamber. A tangential or circumferential direction is a direction tangential to a circumference; it is perpendicular to the axis of the combustion chamber but it does not intersect the axis.

In some embodiments, the first holes may be primary holes, i.e. holes configured to introduce fresh air, e.g. coming from the compressor, so as to use turbulence to define a zone for anchoring the flame between the injectors and said holes in order to ensure that the flame is stable and to ensure good combustion. This zone is referred to as the "primary" zone.

In some embodiments, the first holes may be dilution holes, i.e. holes configured to introduce fresh air, e.g. coming from the compressor, into the core of the combustion chamber, at a distance downstream from the flame of the injector.

In some embodiments, all of the first holes sharing the same closest injector are situated at equal distances from that injector. Thus, throughout the combustion chamber, the first holes are positioned as a function of their distances from the closest injector, thereby making it possible to control the recirculation zones and consequently the temperature field in the combustion chamber.

In some embodiments, the second wall includes second air feed holes downstream from the injectors. The second holes may be positioned in similar manner to the first holes, or in a different manner.

In some embodiments, the second holes, preferably all of the second holes, sharing the same closest injector, are situated at equal distances from the injector. Thus, the positioning of the second holes can likewise be determined, not relative to the chamber end wall, but relative to the injectors that are respectively the closest thereto. Also, the positions of the second holes may be determined independently of the positions of the first holes.

In some embodiments, the first holes and the second holes sharing the same closest injector are situated at equal distances from that injector. This makes it possible to have a temperature field that is radially uniform.

In some embodiments, all of the first and/or second holes are situated respectively at equal distances from the injector that is closest to them. By means of these provisions, the temperature field presents axial symmetry about the axis of the combustion chamber. It is thus more stable and easier to control.

In some embodiments, the first holes and/or the second holes are arranged on circular arcs centered on the respective closest injectors.

In some embodiments, the first wall is a radially outer wall, and the second wall is a radially inner wall. The converse is also possible.

The present disclosure also relates to a turbine engine including an annular combustion chamber as described above.

BRIEF DESCRIPTION OF THE DRAWINGS

The invention and its advantages can be better understood on reading the following detailed description of embodiments of the invention given as nonlimiting examples. The description refers to the accompanying drawings, in which:

FIG. 1 shows a longitudinal section of a sector of a combustion chamber;

FIG. 2 is a radial view of a portion of the first wall in a first embodiment, seen in direction II of FIG. 1;

FIG. 3 is a diagram showing a longitudinal section of a sector of a combustion chamber; and FIG. 4 is a radial view of a portion of the first wall in a second embodiment, seen in direction IV of FIG. 3.

DETAILED DESCRIPTION OF THE INVENTION

FIG. 1 shows a longitudinal section of a sector of a combustion chamber 10 of an aviation turbine engine. The combustion chamber 10 is annular, of longitudinal axis X. It is defined by a first wall 12 that is substantially annular around the axis X, in this example a radially outer wall, by a second wall 13 that is substantially annular around the axis X, in this example a radially inner wall, and by a chamber end wall 14 that connects together the end of the first wall 12 and the facing end of the second wall 13 so as to close the upstream end of the combustion chamber 10. In this example, the chamber end wall 14 is annular.

The annular combustion chamber 10 also has a plurality of fuel injectors 16 that inject fuel into the combustion chamber 10. The injectors 16 are distributed around the longitudinal axis X. In the present embodiment, the injectors are arranged through the chamber end wall 14. Each injector 16 defines an injection direction I.

Air penetrates into the combustion chamber 10 through the chamber end wall 14 via first primary holes 18, optionally via first dilution holes 20, and via cooling holes (not shown), all of these holes being in the first wall 12, and also via second primary holes 19, optionally via second dilution holes 21, and cooling holes (not shown), all of these holes being in the second wall 13. In other words, the first wall 12 has first holes formed by the first primary holes 18 and optionally by the first dilution holes 20. The second wall 13 has second holes formed by the second primary holes 19, and optionally by the second dilution holes 21.

In a first embodiment shown in FIG. 2, for at least one first injector 16, at least three, and preferably at least four, of the first holes 18 that share the first injector 16 as their closest injector are situated along a curve C that is strictly convex in a radial view, the concave side of the curve C facing towards the first injector 16. These first holes 18 may be holes that are consecutive, being adjacent to one another, in particular in a circumferential direction. More precisely, the figure shows six first holes 18, which in this example are first primary holes 18, that are arranged along the strictly convex curve C. In this example, the curve C is a circular arc, specifically centered on the first injector 16 and typically on the injection point A of said first injector 16. Thus, the first holes 18 that share the same closest injector, namely the first injector 16, are situated at equal distances D from the injector.

By means of these provisions, the flame 24 is stabilized by the recirculation zone 26 and is fed by the fuel 22 in suspension.

As can be seen in FIGS. 1 and 2, relative to the orientation of the chamber end wall, the injection direction I is coplanar with the axis X of the combustion chamber.

FIGS. 3 and 4 are views that are analogous respectively to the views of FIGS. 1 and 2, in a second embodiment. In these figures, elements that correspond to or are identical with elements of the first embodiment are given the same reference signs, apart from the hundreds digit, and they are not described again.

In the second embodiment, the injectors 116 are not arranged in the chamber end wall 114. Specifically, the injectors 116 are arranged in the first wall 112. The injectors 116 are also downstream from the chamber end wall 114. Furthermore, as can be seen in FIG. 3, relative to the orientation of the chamber end wall, the injection direction I is not coplanar with the axis X of the combustion chamber. Thus, the injection direction I possesses a nonzero component in the circumferential direction around the axis X. Furthermore, the injection direction I possesses an axial component towards the chamber end wall 114.

In a combustion chamber in the second embodiment, the stream is represented by arrows. The air comes from an outlet 130 of a compressor and enters into the combustion chamber 110 via the injectors 116, via the first primary holes 118, via the second primary holes 119, via the first dilution holes 120, and via the second dilution holes 121. The combustion gas is discharged towards the inlet 132 of a turbine.

In this embodiment, and as shown in FIG. 4, for at least one first injector 116, at least three, and preferably at least four, of the first holes 118 that share the first injector 116 as their closest injector are situated along a curve C that is strictly convex in a radial view, the concave side of the curve C facing towards the first injector 116. More precisely, the figure shows six first holes 118, which in this example are first primary holes 118, four of which are arranged along the strictly convex curve C. The three first holes 118 shown in the bottom right corner of FIG. 4 are in alignment, so all three of them cannot lie on a single strictly convex curve.

By means of these provisions, the positioning of the feeds (in this example the first holes 118) is optimized, with the first holes being positioned in a manner that is consistent with the physical phenomena occurring within the combustion chamber 110. Thus, in spite of the off-axis orientation of the injector 116, the flame 124 is stabilized by the recirculation zone 126, and is fed with the fuel 122 in suspension. Positioning primary holes 118 along a curve that is strictly convex with its concave side facing towards the first injector 118, such as the curve C in FIG. 4, serves to stop the recirculation zone 126 and provides better recirculation of the burnt gas and makes the temperature field in the combustion chamber 110 more uniform.

Although the embodiments described are described concerning a single injector 16, 116 with the first holes 18, 118 in the first wall 12, 112, similar examples could describe the distribution of second holes in the second wall. As mentioned above, the second holes 19, 119 sharing a closest injector 16, 116 could all be situated at equal distances from the injector. This distance may be different from the distance D between the first holes 18, 118 and the injector 16, 116, or else the same, as shown in FIG. 1. Also, the distance between the first and/or second holes and their respective closest injectors may vary from one injector to another, or it may be identical for all of the injectors. It can also be understood that the distance between the first and/or second holes and their respective closest injectors may vary depending on the type of the hole, for example it may be different for the first primary holes 18, 118 and for the first dilution holes 20, 120 that nevertheless share the same closest injector 16, 116.

Although the arrangement of the first holes 18 in the first embodiment is described with reference to a combustion chamber of the type shown in FIG. 1, and the arrangement of the first holes 118 in the second embodiment is described with reference to a combustion chamber of the type shown in FIG. 3, the first embodiment could be applied to a combustion chamber of the type shown in FIG. 3 having injectors situated in one of the annular walls, and the second embodiment could be applied to a combustion chamber of the type shown in FIG. 1 having injectors situated in the chamber end wall.

Although the present invention is described with reference to specific embodiments, modifications may be made to those embodiments without going beyond the general ambit of the invention as defined by the claims. In particular, individual characteristics of the various embodiments shown and/or mentioned may be combined in additional embodiments. Consequently, the description and the drawings should be considered in a sense that is illustrative rather than restrictive.

The invention claimed is:

1. An annular combustion chamber having a first annular wall and a second annular wall that are coaxial about an axis, a chamber end wall connecting together the first and second walls, and a plurality of injectors, the first wall including first air feed holes downstream from the injectors, wherein for at least a first one of said injectors, at least three of the first air feed holes sharing the first injector as a closest injector thereto are situated at equal distances from a point on the first injector.

2. The combustion chamber according to claim 1, wherein the first injector is placed in the first wall.

3. The combustion chamber according to claim 1, wherein the at least three of the first air feed holes includes at least four first air feed holes.

4. The combustion chamber according to claim 1, wherein all of the first air feed holes sharing a same closest injector are situated at equal distances from the same closest injector, wherein the same closest injector is the first injector or a different injector.

5. The combustion chamber according to claim 1, wherein the second wall includes second air feed holes downstream from the plurality of injectors, and wherein the second air feed holes sharing a same closest injector are situated at equal distances from the same closest injector, wherein the same closest injector is the first injector or a different injector.

6. The combustion chamber according to claim 5, wherein the first air feed holes and the second air feed holes sharing a same closest injector are situated at equal distances from the same closest injector, wherein the same closest injector is the first injector or a different injector.

7. The combustion chamber according to claim 5, wherein all of the first and/or second air feed holes are situated respectively at equal distances from a same injector that is closest to them, wherein the same closest injector is the first injector or a different injector.

8. The combustion chamber according to claim 1, wherein the first air feed holes are arranged on circular arcs centered on respective closest injectors.

9. The combustion chamber according to claim 1, wherein the first wall is a radially outer wall, and the second wall is a radially inner wall.

10. A turbine engine including the combustion chamber according to claim 1.

11. The combustion chamber according to claim 5, wherein all of the second air feed holes sharing a same closest injector are situated at equal distances from the same closest injector, wherein the same closest injector is the first injector or a different injector.

12. The combustion chamber according to claim 5, wherein the second air feed holes are arranged on circular arcs centered on respective closest injectors.

* * * * *